US008121317B2

(12) United States Patent
Jhung

(10) Patent No.: US 8,121,317 B2
(45) Date of Patent: Feb. 21, 2012

(54) PIEZOELECTRIC MICROPHONE

(75) Inventor: Jaemyoung Jhung, Seoul (KR)

(73) Assignee: Mems Solution Inc., Gyeonggi-Do (KR)

( * ) Notice: Subject to any disclaimer, the term of this patent is extended or adjusted under 35 U.S.C. 154(b) by 1256 days.

(21) Appl. No.: 11/826,332

(22) Filed: Jul. 13, 2007

(65) Prior Publication Data

US 2008/0019545 A1 Jan. 24, 2008

(30) Foreign Application Priority Data

Jul. 20, 2006 (KR) ..... 10-2006-0067974

(51) Int. Cl.
*H04R 25/00* (2006.01)

(52) U.S. Cl. ..... 381/190; 381/173; 367/155; 367/157; 367/180; 310/311; 310/323.06

(58) Field of Classification Search ..... None
See application file for complete search history.

(56) References Cited

U.S. PATENT DOCUMENTS

| | | | | |
|---|---|---|---|---|
| 2,105,010 | A * | 1/1938 | Sawyer | 381/190 |
| 2,282,319 | A * | 5/1942 | Brown | 381/95 |
| 3,987,320 | A * | 10/1976 | Merhar | 310/339 |
| 2005/0129261 | A1 * | 6/2005 | Ito et al. | 381/190 |

FOREIGN PATENT DOCUMENTS

JP 10-68742 10/1998

* cited by examiner

*Primary Examiner* — Charles Garber
*Assistant Examiner* — Yasser Abdelaziez
(74) *Attorney, Agent, or Firm* — Rabin & Berdo, P.C.

(57) ABSTRACT

Provided is a piezoelectric microphone. The piezoelectric microphone includes a plurality of cells each having a lower electrode, a piezoelectric layer, and an upper electrode. The cells can be arranged on a protection layer in various patterns. Since the piezoelectric microphone includes the plurality of cells, the voltage level of a piezoelectric signal of the piezoelectric microphone can be easily increased to a desired level by adjusting the number of the cells. Thus, the sensitivity of the piezoelectric microphone can be increased.

5 Claims, 7 Drawing Sheets

PIEZOELECTRIC MICROPHONE

BACKGROUND OF THE INVENTION

1. Field of the Invention

The present invention relates to a microphone, and more particularly, to a piezoelectric microphone.

2. Description of the Related Art

Microphones are used to convert sound waves or ultrasonic waves into electric signals.

Examples of the microphones include a carbonic microphone, a piezoelectric microphone, a movable-coil microphone, a vibration-diaphragm microphone, a condenser microphone, and a semiconductor microphone. The carbonic microphone operates using the pressure-dependent electric resistance of carbon particles. The movable-coil microphone operates using a current induced by a vibration of a coil attached to a vibration coil. The vibration-diaphragm microphone operates using an induced current generating when a sound wave vibrates a ribbon-shaped diaphragm disposed in a magnetic field. The condenser microphone operates using the concept of a condenser in which thin-vibration plates (fixed electrodes) face each other at a close distance. The semiconductor microphone operates using a stress semiconductor having an electric resistance varying according to a mechanical force applied to the stress semiconductor.

FIGS. 1 and 2 illustrate a conventional piezoelectric microphone. In the conventional piezoelectric microphone, a lower electrode 20, a piezoelectric layer 30 formed of a piezoelectric material such as aluminum nitride AlN and piezoelectric ceramic, and an upper electrode 40 are sequentially formed on a protection layer 10 deposited on a silicon substrate (S).

The conventional piezoelectric microphone can be fabricated through a process illustrated in FIG. 3.

Referring to FIG. 3, in operation S10, the protection layer 10 is deposited on the silicon substrate (S). In operation S12, the lower electrode 20, the piezoelectric layer 30, and the upper electrode 40 are sequentially deposited on the protection layer 10. In operation S14, the backside of the silicon substrate (S) is etched by back-side etching to remove a center portion of the silicon substrate (S) until the bottom surface of the protection layer 10 is exposed.

The piezoelectric layer 30 generates a piezoelectric signal in proportion to an applied sound pressure, and the piezoelectric signal is transmitted to an external amplifier through the lower and upper electrodes 20 and 40.

Since the lower electrode 20, the piezoelectric layer 30, and the upper electrode 40 are formed into a simple parallel plate structure, the voltage level of the piezoelectric signal generated in response to the sound pressure is limited to below a predetermined value. As a result, it is difficult to increase the sensitivity of the piezoelectric microphone.

SUMMARY OF THE INVENTION

Accordingly, the present invention is directed to a piezoelectric microphone that substantially obviates one or more problems due to limitations and disadvantages of the related art.

An object of the present invention is to provide a piezoelectric microphone including a plurality of variously arranged cells each having a lower electrode, a piezoelectric layer, and an upper electrode.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a piezoelectric microphone including a plurality of cells arranged on a protection layer in various pattern, wherein each of the cell includes a lower electrode, a piezoelectric layer, and an upper electrode.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the embodiments of the present invention, examples of which are illustrated in the accompanying drawings.

Referring to FIGS. 4 to 9, a piezoelectric microphone of the present invention includes a plurality of cells arranged in various patterns on a protection layer 10*a* or 10*b* deposited on a silicon substrate (S).

The cells are connected in series. Each cell includes a lower electrode 20*a* or 20*b*, a piezoelectric layer 30*a* or 30*b* formed of a piezoelectric material such as aluminum nitride AlN and piezoelectric ceramic, and an upper electrode 40*a* or 40*b* that are formed on the protection layer 10*a* or 10*b*.

As explained above, the piezoelectric microphone of the present invention includes the cells. Each of the cells is formed by sequentially stacking the lower electrode 20*a* or

20*b*, the piezoelectric layer 30*a* or 30*b*, and the upper electrode 40*a* or 40*b* on the protection layer 10*a* or 10*b* deposited on the silicon substrate (S). The cells can be arranged in various patterns. Thereafter, the backside of the silicon substrate (S) is etched by back-side etching to remove a center portion of the silicon substrate (S) until the bottom surface of the protection layer 10*a* or 10*b* is exposed. Exemplary embodiments of the present invention will now be described.

Figure 1:
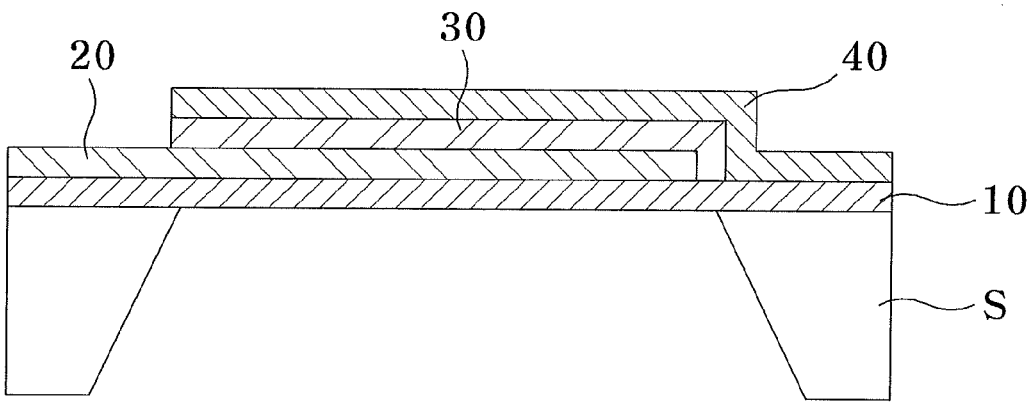
FIG. 1 Prior Art
FIG. 1 is a cross-sectional view illustrating a conventional piezoelectric microphone.
Figure 2:
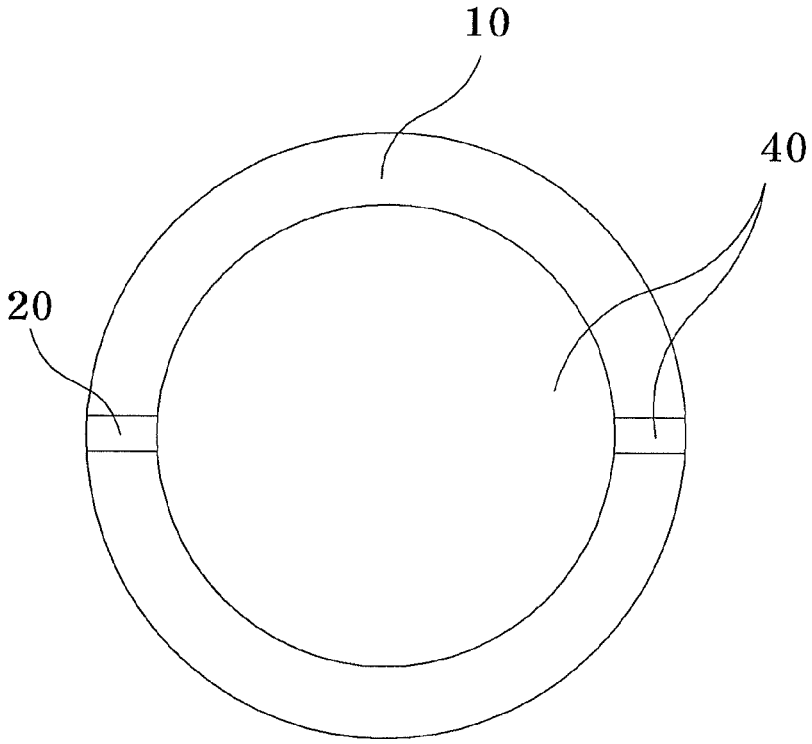
FIG. 2 Prior Art
FIG. 2 is a plan view of the piezoelectric microphone depicted in FIG. 1.
Figure 3:
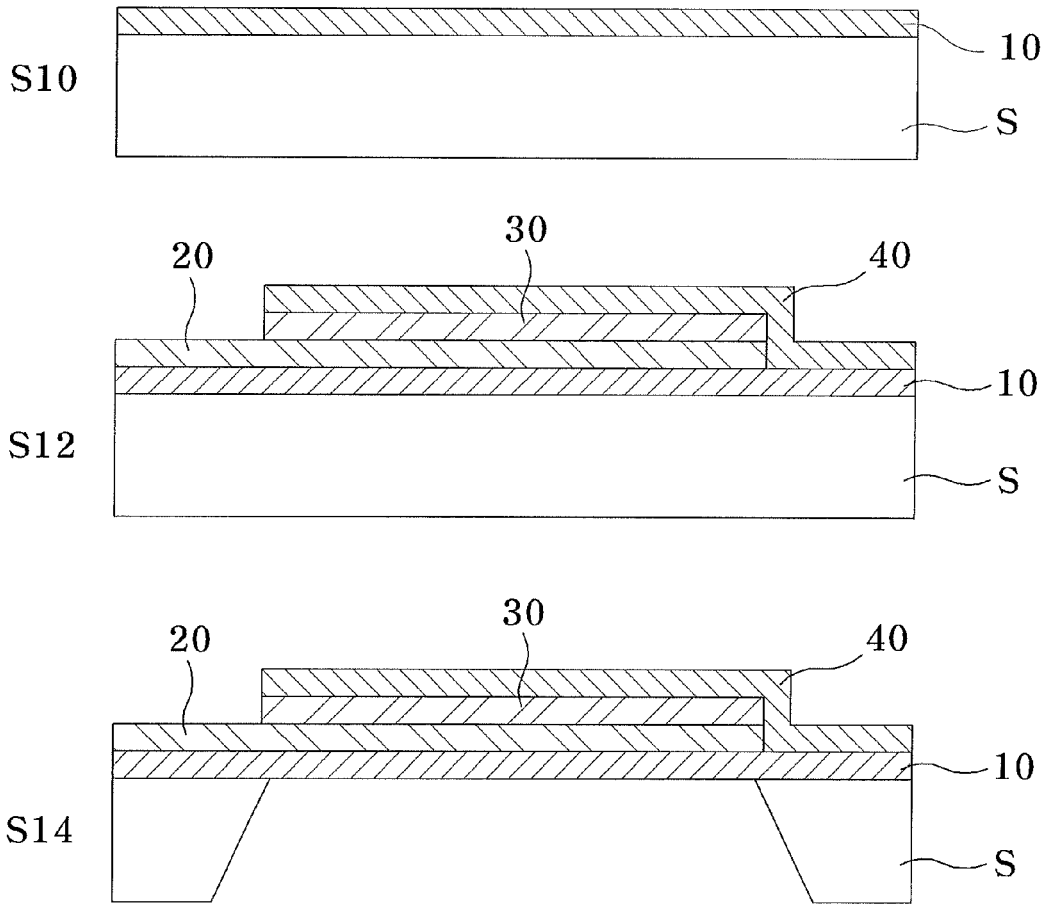
FIG. 3 Prior Art
FIG. 3 is a view for explaining a manufacturing process of a conventional piezoelectric microphone.
Figure 4:
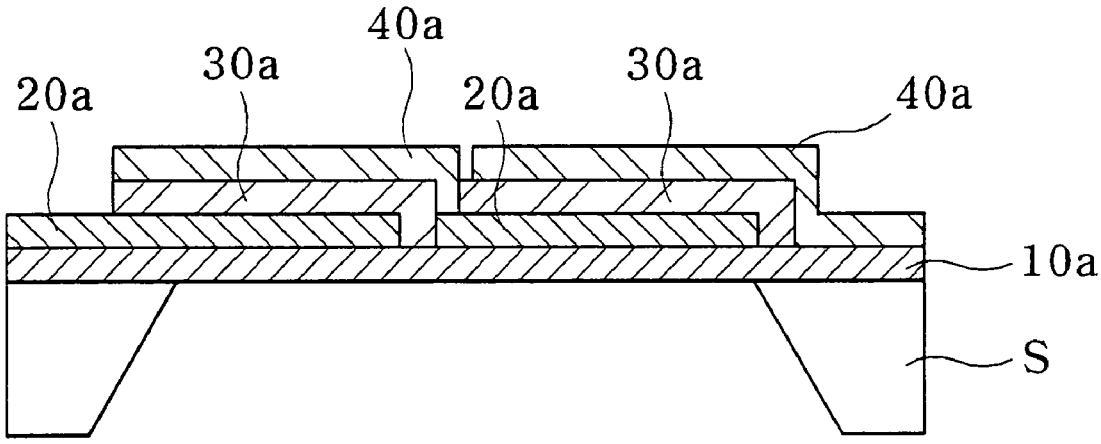
FIG. 4 is a cross-sectional view illustrating a piezoelectric microphone according to a first embodiment of the present invention.
Figure 5:
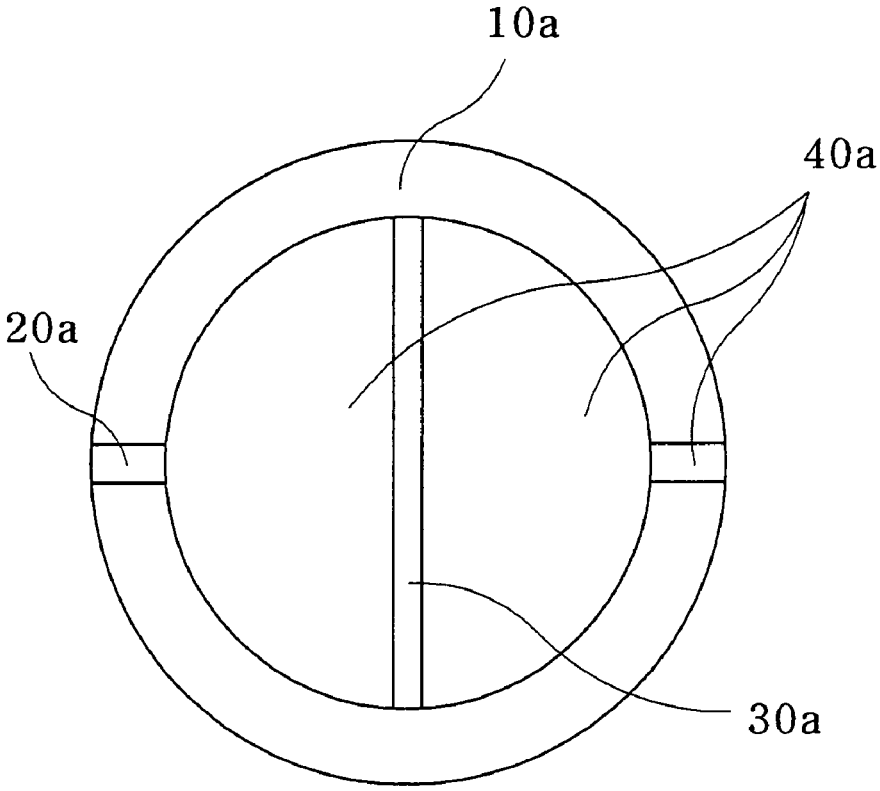
FIG. 5 is a plan view illustrating the piezoelectric microphone depicted in FIG. 4.

FIGS. 4 and 5 are a cross-sectional view and a plan view illustrating a piezoelectric microphone according to a first embodiment of the present invention. Referring to FIGS. 4 and 5, the piezoelectric microphone includes two semicircular cells arranged on a protection layer 10*a*.

Figure 6:
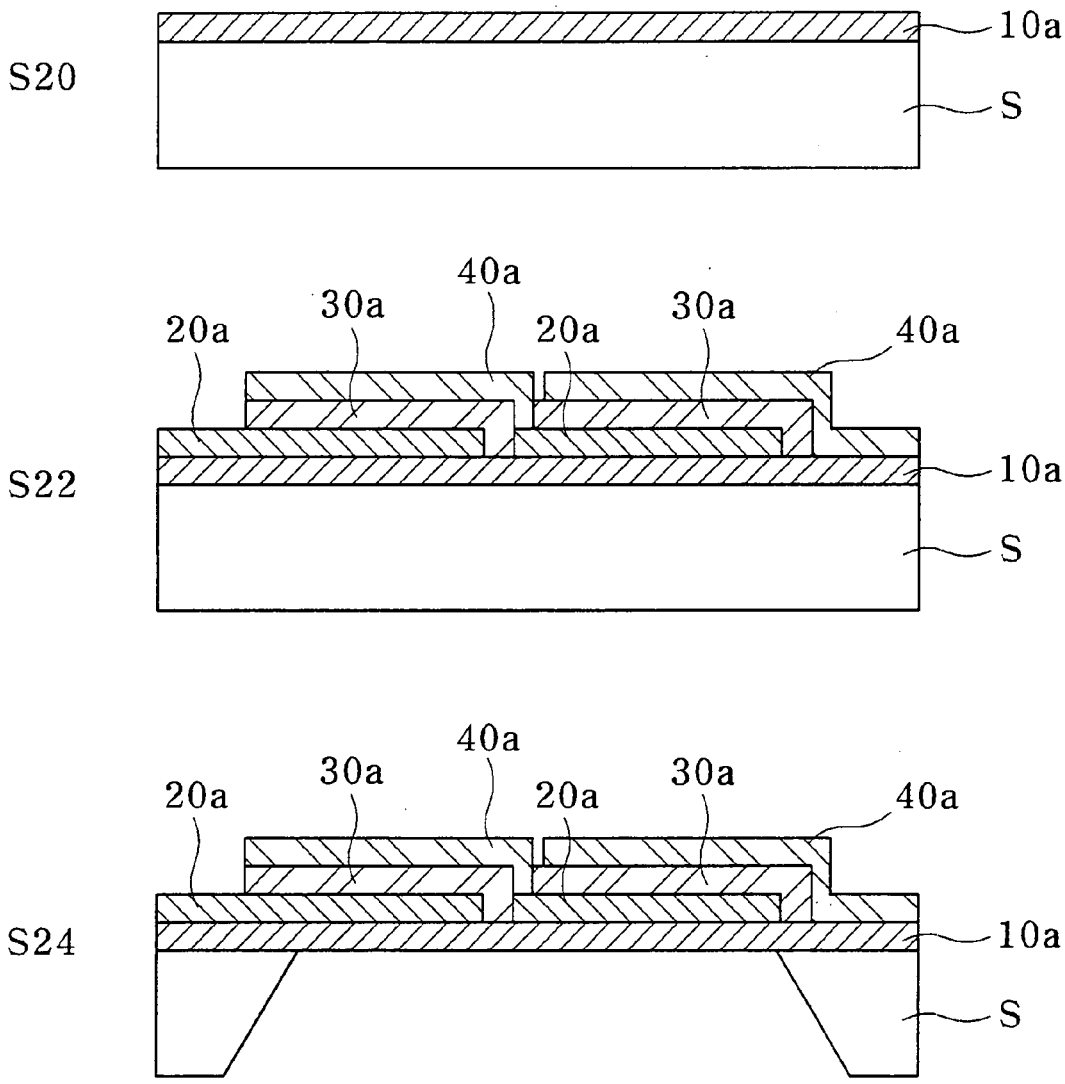
FIG. 6 is a view for explaining a manufacturing process of the piezoelectric microphone depicted in FIG. 4.

The piezoelectric microphone of the current embodiment can be fabricated as shown in FIG. 6.

Referring to FIG. 6, the piezoelectric microphone of the first embodiment is fabricated as follows. In operation S20, the protection layer 10*a* is deposited on a silicon substrate (S). In operation S22, two semicircular cells are formed on the protection layer 10*a*. Each of the two semicircular cells includes a lower electrode 20*a*, a piezoelectric layer 30*a*, and an upper electrode 40*a* that are sequentially stacked on the protection layer 10*a*. In operation S24, the backside of the silicon substrate (S) is etched by back-side etching to remove a center portion of the silicon substrate (S) until the bottom surface of the protection layer 10*a* is exposed.

Figure 7:
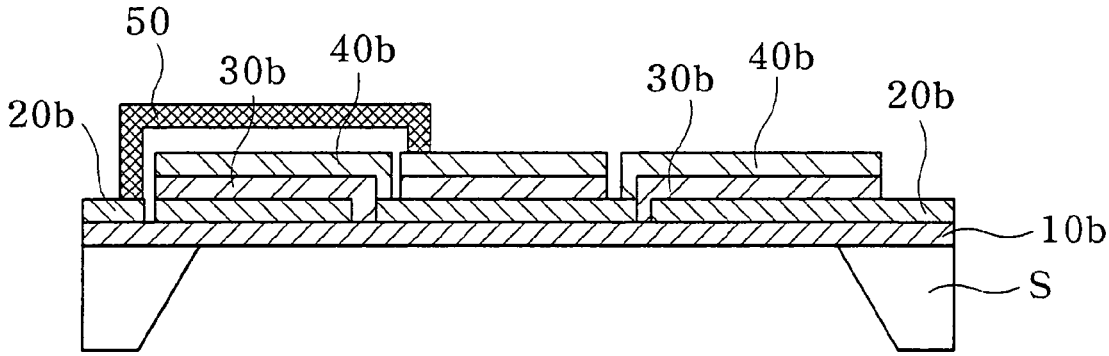
FIG. 7 is a cross-sectional view illustrating a piezoelectric microphone according to a second embodiment of the present invention.
Figure 8:
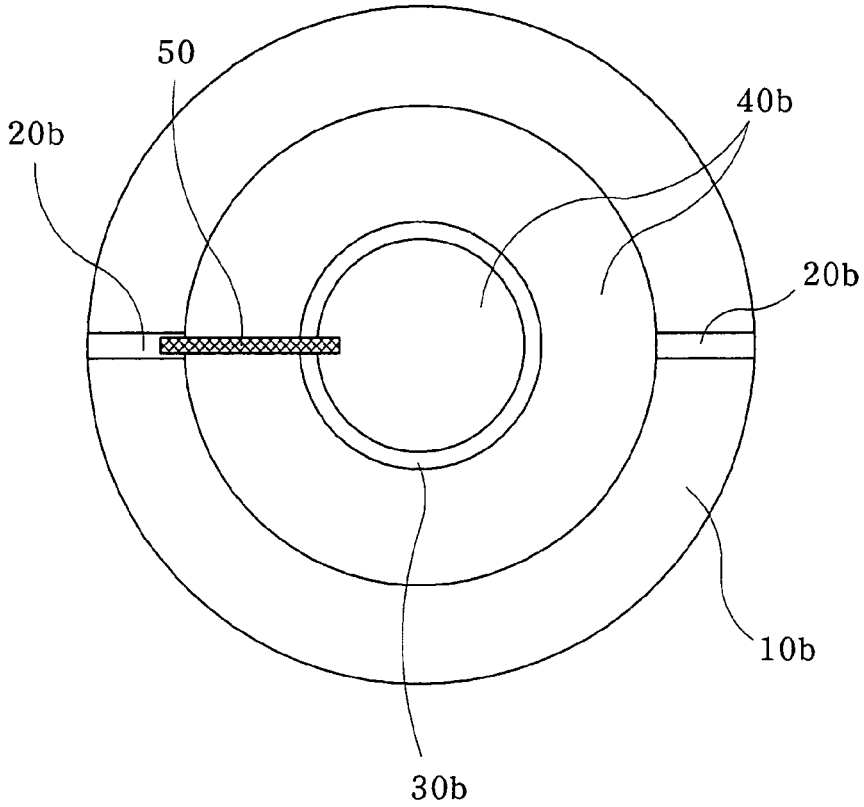
FIG. 8 is a plan view illustrating the piezoelectric microphone depicted in FIG. 7.

FIGS. 7 and 8 are a cross-sectional view and a plan view illustrating a piezoelectric microphone according to a second embodiment of the present invention. Referring to FIGS. 7 and 8, the piezoelectric microphone includes two coaxial cells arranged on a protection layer 10*b*.

Figure 9:
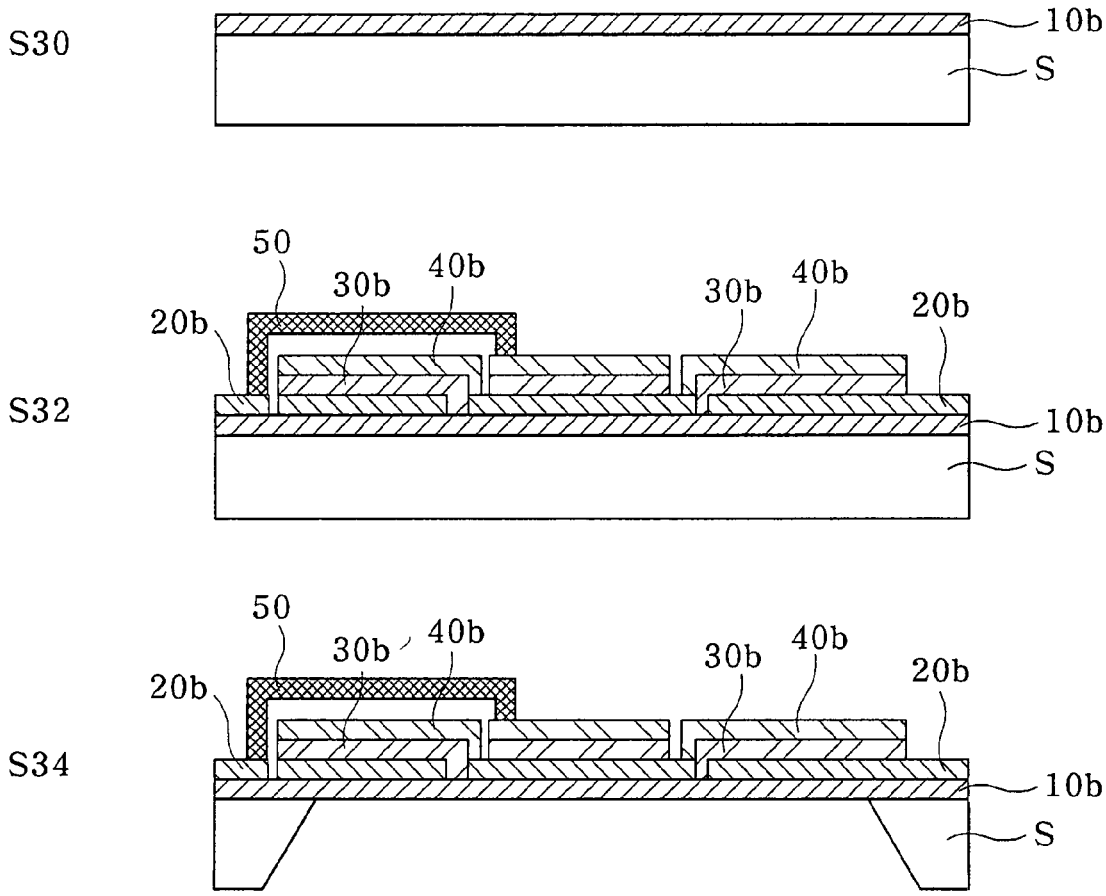
FIG. 9 is a view for explaining a manufacturing process of the piezoelectric microphone depicted in FIG. 7.

The piezoelectric microphone of the current embodiment can be fabricated as shown in FIG. 9.

Referring to FIG. 9, the piezoelectric microphone of the second embodiment is fabricated as follows. In operation S30, the protection layer 10*b* is deposited on a silicon substrate (S). In operation S32, two coaxial cells are formed on the protection layer 10*a*. Each of the two coaxial cells includes a lower electrode 20*b*, a piezoelectric layer 30*b*, and an upper electrode 40*b* that are sequentially stacked on the protection layer 10*a*. The upper electrodes 40*b* of the two coaxial cells are connected using an air bridge 50. Then, in operation S34, the backside of the silicon substrate (S) is etched by back-side etching to remove a center portion of the silicon substrate (S) until the bottom surface of the protection layer 10*b* is exposed.

Figure 10:
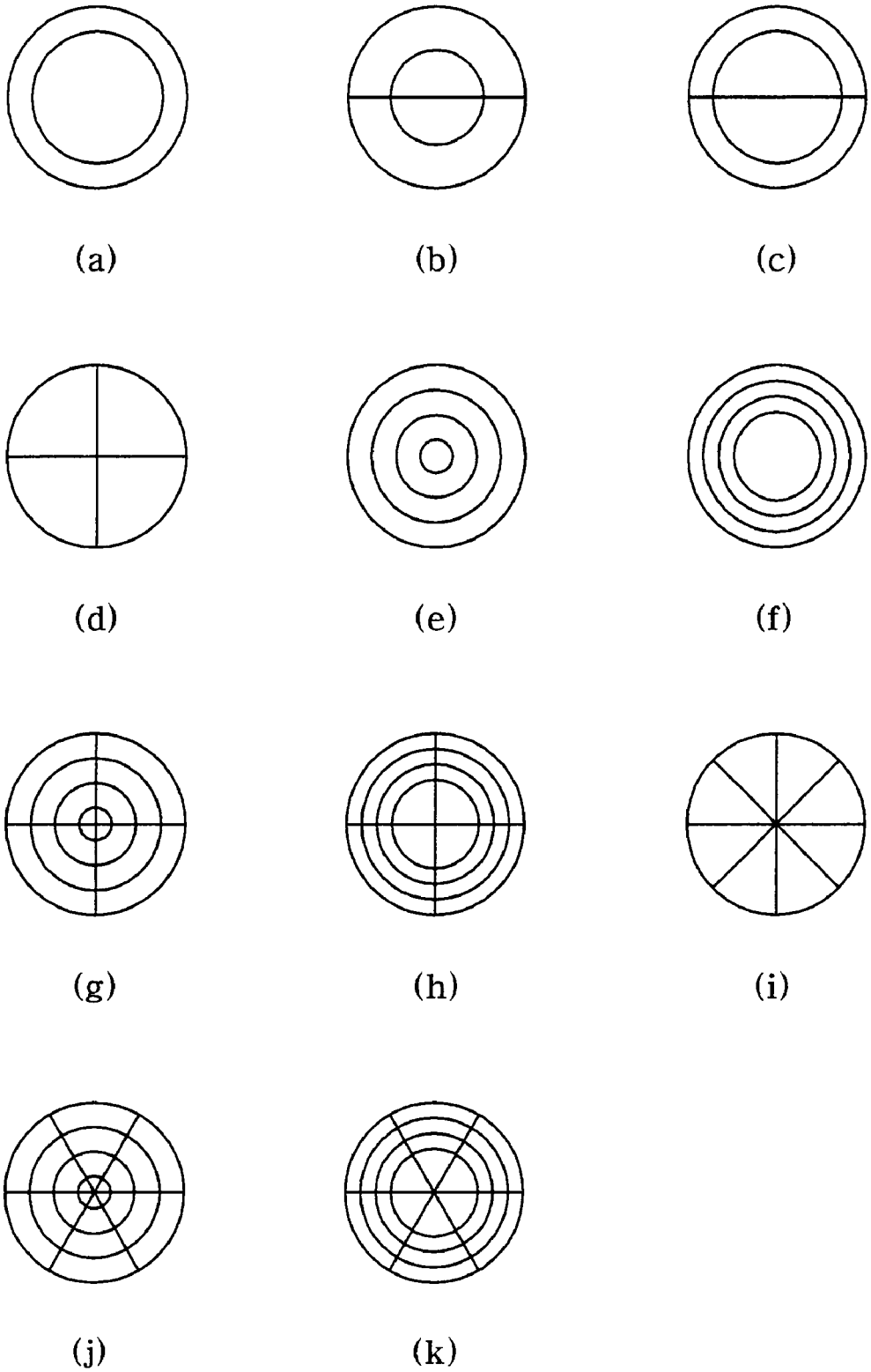
FIG. 10 is a plan view illustrating exemplary cell arrangements of a piezoelectric microphone according to the present invention.

FIG. 10 is a plan view illustrating exemplary cell arrangements of a piezoelectric microphone according to the present invention.

For example, referring to FIG. 10(*a*), two coaxial cells are arranged on a protection layer like those shown in FIGS. 7 and 8. In this case, the inner cell having a circular shape has the same area as the outer cell having a ring shape.

The piezoelectric microphone of the present invention operates as follows.

In each cell of the piezoelectric microphone, the piezoelectric layer 30*a* or 30*b* generates a piezoelectric signal in proportion to an applied sound pressure, and the piezoelectric signal is transmitted to an external amplifier through the lower electrode 20*a* or 20*b* and the upper electrode 40*a* or 40*b*.

Since the piezoelectric signals of the respective cells are added, the total piezoelectric signal corresponding to the applied sound pressure can have an increased voltage level.

For example, when the piezoelectric microphone includes n cells and a sound pressure is applied to the piezoelectric microphone, the n cells generate n piezoelectric signals in response to the sound pressure. Hence, the total piezoelectric signal of the piezoelectric microphone can have the same voltage level as the sum of voltages levels of the n piezoelectric signals.

Therefore, according to the present invention, the voltage level of a total piezoelectric signal can be easily increased to a desired level by adjusting the number of the cells of the piezoelectric microphone. Accordingly, the sensitivity of the piezoelectric microphone can be increased.

As described above, the piezoelectric microphone of the present invention includes a plurality of cells each having the lower electrode, the piezoelectric layer, and the upper electrode. The cells can be arranged on the protection layer in various patterns. The piezoelectric microphone of the present invention includes the plurality of cells although a piezoelectric microphone of the related art includes a single parallel plate structure including a lower electrode, a piezoelectric layer, and an upper electrode. Therefore, according to the present invention, the voltage level of a piezoelectric signal of the piezoelectric microphone can be easily increased to a desired level by adjusting the number of the cells. Thus, the sensitivity of the piezoelectric microphone can be increased.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A piezoelectric microphone comprising a plurality of cells arranged side by side on a protection layer, wherein each of the cell includes a lower electrode, a piezoelectric layer, and an upper electrode, wherein the number of the cell is n, and each of the n cells generates a piezoelectric signal having a unit voltage level, and a total piezoelectric signal of the piezoelectric microphone corresponding to the sound pressure has a voltage level that is n times the unit voltage level.

2. The piezoelectric microphone of claim 1, wherein the cells have a semicircular shape.

3. The piezoelectric microphone of claim 1, wherein the cells are arranged on the protection layer in a circular shape divided into n parts, each cell forms one of the n parts, and the cells are connected in series.

4. The piezoelectric microphone of claim 1, wherein the cells are arranged on the protection layer in m concentric circles that share the same center with one inside the other.

5. The piezoelectric microphone of claim 1, wherein a lower surface of the lower electrode of each cell comes in contact with the protection layer.

* * * * *